US005336867A

United States Patent [19]

Miller

[11] Patent Number: 5,336,867

[45] Date of Patent: Aug. 9, 1994

[54] CONVECTION OVEN TAPERED AIR HEATING CHAMBER

[75] Inventor: Matthew S. Miller, Louisville, Ky.

[73] Assignee: General Electric Company, Louisville, Ky.

[21] Appl. No.: 165,796

[22] Filed: Dec. 13, 1993

[51] Int. Cl.[5] ..... A21B 1/26; F27D 7/04; F24H 3/04

[52] U.S. Cl. ..... 219/400; 126/21 A

[58] Field of Search ..... 219/400; 126/21 A, 21 R

[56] References Cited

U.S. PATENT DOCUMENTS

| | | | |
|---|---|---|---|
| 3,529,582 | 9/1970 | Hurko | 219/400 |
| 4,030,476 | 6/1977 | Hock | 219/400 |
| 4,357,522 | 11/1982 | Husslein et al. | 219/400 |
| 4,679,542 | 7/1987 | Smith | 126/21 A |
| 4,780,596 | 10/1988 | Matsushima | 219/400 |
| 4,870,254 | 9/1989 | Arabori et al. | 219/400 |
| 5,131,841 | 7/1972 | Smith | 126/21 A |
| 5,142,125 | 8/1992 | Fioroli et al. | 219/400 |
| 5,165,889 | 11/1992 | Baggott | 126/21 A |

FOREIGN PATENT DOCUMENTS

| | | |
|---|---|---|
| 57-41529 | 3/1982 | Japan . |
| 63-29123 | 2/1988 | Japan . |
| 217323 | 1/1990 | Japan . |

*Primary Examiner*—Teresa J. Walberg
*Attorney, Agent, or Firm*—H. Neil Houser

[57] ABSTRACT

A forced air convection oven includes a cooking compartment and an air heating chamber adjacent to one wall of the cooking compartment. An air circulating fan and an air heater are mounted in a central section of the chamber. An elongated section of the chamber extends from the fan along the compartment wall and has an uniformly decreasing cross section area. There is an inlet opening in the compartment wall aligned with the fan and a plurality of outlet openings uniformly spaced apart along the compartment wall communicating with the elongated chamber section. Each outlet opening has a cross sectional area equal to the cross section area of the end of the elongated section adjacent to the fan divided by the number of outlet openings.

10 Claims, 2 Drawing Sheets

CONVECTION OVEN TAPERED AIR HEATING CHAMBER

BACKGROUND OF THE INVENTION

This invention relates to forced air convection ovens, and more particularly to an improved air flow system for such ovens.

Forced air convection ovens have been known for many years and have become more popular for household or domestic use in recent years. In a convection oven air is heated outside the cooking compartment and the heated air then is blown into the compartment to cook food in the compartment. They have the advantage of normally cooking in less time than cooking with radiant heat. A large item will occupy a large portion of the cooking compartment and, when cooking several smaller items each will be in a different place in the compartment. Thus, it is important that the flow of heated air to the compartment be uniform throughout the cooking compartment. This is of particular concern in smaller domestic ovens which tend to have smaller, less powerful fans. Many attempts have been made to improve the air flow in convection ovens, without complete success.

An object of this invention is to provide a forced air convection oven with an improved air flow system.

Another object is to provide such a system which provides improved, more uniform air flow to the cooking compartment.

Still another object of the present invention is to provide such an improved system that is simple and easy to manufacture.

SUMMARY OF THE INVENTION

In accordance with one form of the present invention a forced air convection oven includes planar top, bottom, side and rear walls defining a cooking compartment. An air heating chamber is provided with one wall of the chamber being the rear wall of the cooking compartment. The chamber includes a first section positioned centrally of the cooking compartment rear wall and elongated sections extending laterally of the rear wall to each side of the first section. An air circulating fan and an air heater are positioned in the first chamber section. The cooking compartment rear wall includes an inlet opening communicating with the first section and a plurality of outlet openings communicating with each of the elongated sections so that the fan draws air from the cooking compartment into the first chamber section through the inlet opening and discharges heated air into the cooking compartment through the outlet openings. The cross section area of each elongated section decreases uniformly in the lateral direction away from the first chamber section. The outlet openings communicating with each elongated section are uniformly spaced apart along the rear wall and the cross section area of each outlet opening for an elongated section is substantially equal to the cross section area of that elongated section at its junction with the first section, divided by the number of outlet openings for that elongated section.

DETAILED DESCRIPTION OF PREFERRED EMBODIMENT

Figure 1:
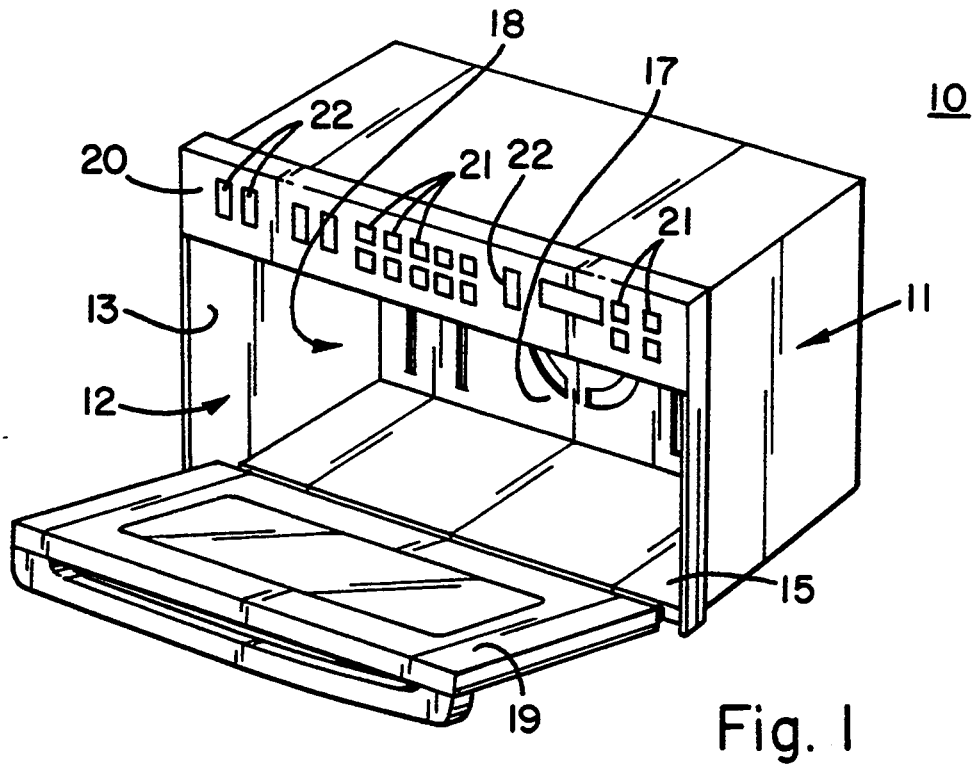
FIG. 1 is a a simplified front perspective view of a domestic forced air convection oven incorporating one embodiment of the present invention, with the access door open for purposes of illustration.
Figure 2:
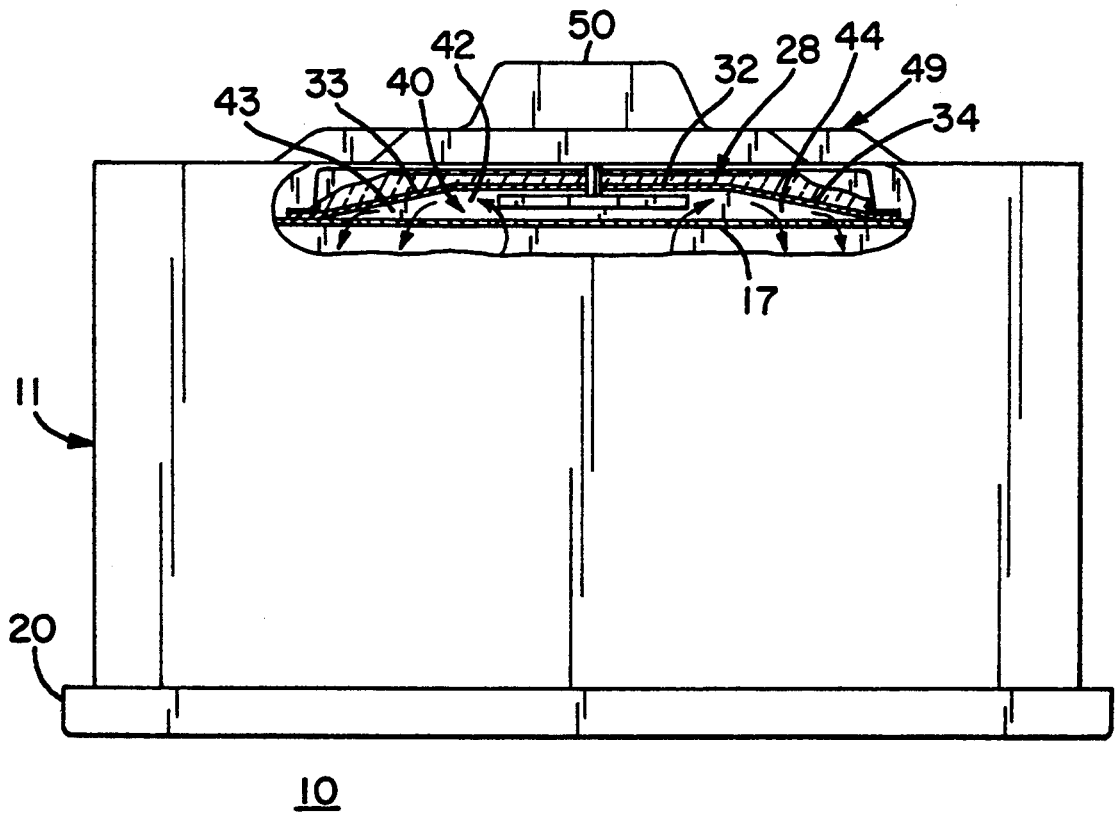
FIG. 2 is a simplified top plan view of the oven of FIG. 1, the view being partly broken away for illustration.
Figure 3:
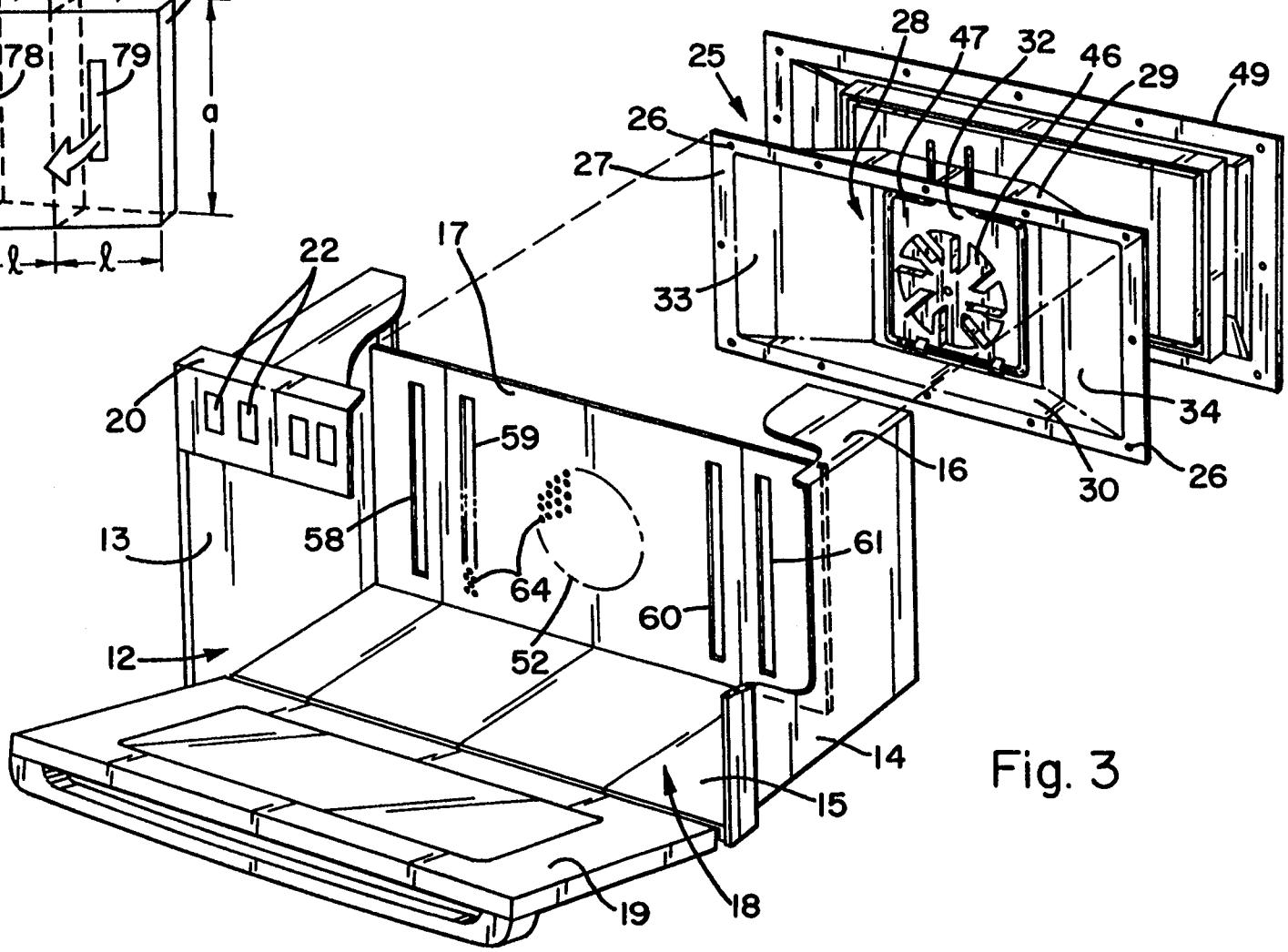
FIG. 3 is a partial exploded view of the oven of FIG. 1, illustrating certain aspects of the cooking compartment and the air heating chamber.

Referring now to FIGS. 1–3, there is shown a forced air convection oven of the domestic type, that is one sized to be used in households. Often such ovens have the capability to cook as either a convection oven or as a microwave oven. However, those components which relate only to microwave cooking have been omitted for the sake of simplicity, as they are not involved in the present invention.

The oven 10 includes an outer cabinet 11 which contains a housing or liner 12 with side walls 13, 14, a bottom wall 15, a top wall 16 and rear wall 17, defining a cooking compartment 18. The walls of the liner 12 are spaced from the corresponding walls of the housing and the space may be filled with heat and sound insulation if desired. The front of the compartment 18 is open and a door 19 is hinged along its bottom to the cabinet 11 to move between the position shown, opening or exposing the cooking compartment for the insertion and removal of items to be cooked, and a position lying against the edge of the cabinet around the liner, closing the compartment for cooking. The cabinet includes a control panel 20 which contains controls, such as buttons or switches 21, and indicator lights 22, used to control operation of the oven.

Referring now particularly to FIGS. 2 and 3, a shroud 25 is attached to and covers the outside of rear wall 17. The attachment may be accomplished in any known manner, such as by screws which pass through openings 26 in a peripheral flange 27 of the shroud and are received in the rear wall 17. The shroud 25 includes a back wall 28 joined to spaced apart top wall 29 and bottom wall 30. The back wall 28 includes a first or central portion 32 which is parallel to and spaced a predetermined distance from the central portion of rear wall 17. The back wall 28 also includes elongated second and third portions 33, 34 which extend laterally to each side of central portion 32 laterally along rear wall 17 and are angled toward wall 17 so as to terminate at the flange 27 adjacent the lateral edges of the wall 17. The top and bottom walls 29, 30 of shroud 25 extend between the flange 27 and back wall 28 so that, when the shroud is mounted to rear wall 17, they form there between an air heating chamber 40 which has a first or central section 42 and elongated sections 43, 44 respectively. More particularly the central section 42 is between central portion 32 of back wall 28 and the corresponding portion of cooking compartment rear wall 17; while elongated chamber section 43 is between angled portion 33 of back wall 28 and the corresponding portion of rear wall 17 and elongated chamber section 44 is between angled portion 34 of back wall 28 and the corresponding portion of rear wall 17. The angled portions 33 and 34 of back wall 28 are substantially straight and each forms a predetermined angle with the rear wall 17. The top and bottom walls 29, 30 are parallel and substantially perpendicular to walls 17 and 28. Thus the cross section area of each of the elongated sections 43, 44 of air heating chamber 40 tapers in an uniform manner from its junction with central section 42 laterally to the junction of back wall portions 33, 34 with rear wall 17.

An air circulation fan 46 is mounted in the central section 42 and conveniently may take the form of a centrifugal blower. Air heating means, conveniently in the form of a sheathed heater 47, is mounted in the section 42 adjacent the fan 46. As illustrated, the heater 47 extends along the sides of the fan or blower 46 so that, as the fan operates it pulls air in at its center and expels the air laterally over the heater. A back 49 for the cabinet 11 is mounted over the back wall 28 on the opposite side from liner rear wall 17 and conveniently includes a rearwardly projecting extension 50 which houses an electric motor, not shown, for operating or rotating the fan 46.

Referring particularly to FIG. 3, it will be seen that cooking compartment rear wall 17 includes a central air inlet opening 52 aligned with the fan 46 and communicating with central chamber section 42. Additionally, air exit openings, in the form of vertically elongated slots 58,59, 60 and 61 are formed in rear wall 17. The slots 58 and 59 communicate with the elongated air chamber section 43 while the slots 60 and 61 communicate with elongated section 44. For the sake of convenience the inlet opening 62 and 58–61 generally have been shown as single openings. However, it is important to limit each individual hole in the rear wall to a small enough size that a user cannot insert his/her finger or a common tool into the air heating chamber in such a way that it is likely to come into contact with either the fan 46 or the heater 47. A convenient manner of accomplishing this is to form the opening 52 and slots 58–61 as a series of closely spaced, small diameter holes, as shown at 64. When the rear wall 17 is constructed from metal this conveniently may be accomplished by piercing the holes 64. When the wall 17 is molded as a sheet of plastic material, the holes 64 conveniently may be formed in the molding process. Of course other construction approaches may be taken; such as, for example, separate sheets of perforated material can be attached to the air heating chamber side of wall 17 in register with opening 52 and slots 58–61. In any event the effective size of each slot or opening is the total cumulative size or area of all the holes in that opening.

When the fan 46 operates it draws air from cooking compartment 18 through inlet opening 52, over air heater 47, and discharges the heated air from the air heating chamber 40 into the cooking compartment 18 through discharge openings or slots 58–61. In order to help assure an even distribution of the heated air discharged into the compartment 18, the air discharge openings communicating with each elongated chamber section are evenly positioned or spaced apart along the corresponding portion of the rear wall 17 and each discharge opening has an effective cross section area equal to the cross section area of the entrance of that elongated section, that is its junction with the central section, divided by the number of outlet openings communicating with that elongated section. In the embodiment illustrated in FIGS. 1–3, the discharge openings 58,59 and 60,61 respectively are positioned approximately $\frac{1}{3}$ and $\frac{2}{3}$ of the distance form the central section 42 to the terminus or opposite end of elongated sections 43 and 44 respectively. Also the effective cross section area of each opening 58–61 is substantially equal to the cross section area of the entrance of elongated sections 43, 44 respectively. That is, each is substantially equal to the cross section area of air heating chamber at the junction of central section 42 with elongated sections 43, 44 respectively, divided by the number of discharge openings communicating with that discharge section. In the illustrated embodiment the air heating chamber is symmetric, and thus the discharge openings are of uniform size. More specifically, each is approximately $\frac{1}{2}$ the cross section area of the entrance to each elongated section.

Figure 4:
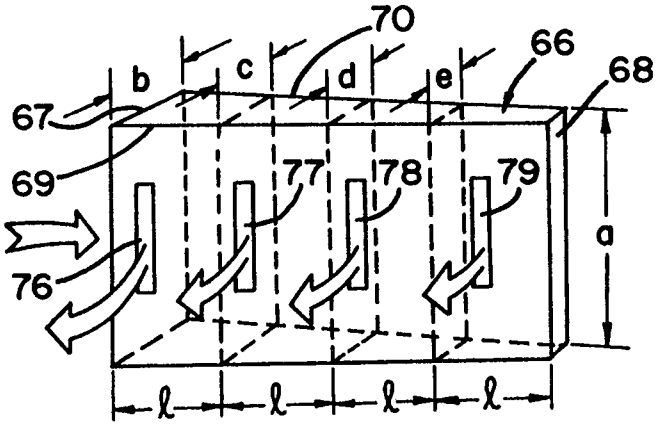
FIG. 4 is a schematic drawing of an elongated section of an air heating chamber illustrating certain aspects of the present invention.

Referring now to FIG. 4, there is schematically illustrated an elongated section 66 of an air heating chamber which is larger than sections 43, 44 of FIGS. 1–3 and incorporates more air discharge openings. The elongated section 66 has an entrance 67 and a terminus 68. The side wall 69 slopes or angles toward the side wall 70 in an uniform manner so that the cross section area of the section 66 tapers uniformly from entrance 67 to terminus 68. Four exit or discharge openings 71, 72, 73 and 74 are spaced apart along the section 66 in a substantially uniform manner. That is opening 71 is adjacent the entrance 67, opening 72 is approximately $\frac{1}{4}$ the way to terminus 68, opening 73 is approximately $\frac{1}{2}$ the way to terminus 68 and opening 74 is approximately $\frac{3}{4}$ the way to terminus 68. The cross section area of the section at any point along its length is the product of the height and width of the section at that point. Thus the cross section area of the entrance 67 is indicated by ab; at the $\frac{1}{4}$ point it is ac; at the $\frac{1}{2}$ point it is ad and at the $\frac{3}{4}$ point it is ae. Since the section has an uniform taper $ac=\frac{3}{4}$ ab, $ad=\frac{1}{2}$ ab and $ae=\frac{1}{4}$ ab. As there are four exit or discharge openings 75, 76, 77 and 78, each discharge opening has an effective cross section area one fourth the entrance cross section area, that is each exit opening is $\frac{1}{4}$ ab.

While specific embodiments of the present invention have been described herein, it is realized that modifications and changes will occur to those skilled in the art to which the invention pertains. It is therefore intended that the appended claims cover all such modifications and changes as fall within the true spirit and scope of the invention.

What is claimed is:

1. A forced air convection oven comprising:

a liner defining a cooking compartment therein, said housing including top, bottom, side and rear walls and an open front providing access to said compartment for inserting and removing food;

a door mounted for movement to selectively open and close said compartment front;

an air heating chamber positioned adjacent a predetermined one of said cooking compartment walls; an air circulation fan mounted in said chamber and air heating means mounted adjacent said fan, an air inlet opening in said predetermined cooking chamber wall aligned with said fan and a plurality of air outlet openings in said predetermined compartment wall remote from said fan, so that operation of said fan draws air into said air heating chamber from said cooking compartment through said inlet opening over said heating means and discharges heated air from said chamber into said cooking compartment through said air outlet openings; and said air heating chamber including an elongated section extending away from said fan along said predetermined compartment wall, the cross section area of said elongated section uniformly decreasing in the direction away from said fan; predetermined ones of said outlet openings being substantially uniformly spaced apart along said predetermined compartment wall; and each of said predetermined outlet openings having an effective cross section area substantially equal to the cross section area of said elongated heating chamber section adjacent said fan divided by the total number of said predetermined outlet openings.

2. A forced air convection oven as set forth in claim 1, wherein: said predetermined ones of said outlet openings are elongated in a direction substantially perpendicular to the direction of elongation of said heating chamber section.

3. A forced air convection oven comprising:

a liner defining a cooking compartment therein, including planar top, bottom, side and rear walls and an open front for insertion and removal of food;

a door mounted for movement to selectively open and close said compartment front;

means, including said compartment rear wall, defining an air heating chamber adjacent the side of said rear wall opposite said cooking compartment, said chamber including a first section positioned centrally of said rear wall and a separate elongated section extending laterally along said rear wall to each side of said first section;

an air circulating fan and air heating means mounted in said first chamber section;

said rear wall including an air inlet opening communicating with said first chamber section and a plurality of air outlet openings communicating with each of said elongated chamber sections so that operation of said fan draws air into said chamber from said cooking compartment through said inlet opening over said heating means and discharges heated air from said chamber to said compartment through said outlet openings;

the cross section area of each elongated section uniformly decreasing in the lateral direction away from the first chamber section; said outlet openings communicating with each elongated section being substantially evenly spaced apart along said rear wall and each outlet opening communicating with an elongated section having an effective cross section area substantially equal to the cross section area of said air heating chamber at the junction between said first chamber section and that elongated section divided by the number of outlet openings communicating with that elongated section.

4. A forced air convection oven as set forth in claim 3, wherein: said outlet openings are elongated vertically of said rear wall.

5. A forced air convection oven as set forth in claim 3, wherein: each of said outlet openings is comprised of a plurality of small, closely spaced holes in said rear wall and the effective cross section area of each of said outlet openings is substantially the cumulative total of the cross section areas of all the small holes comprising that opening.

6. A forced air convection oven as set forth in claim 3, wherein: said air chamber defining means includes a shroud attached to said compartment rear wall, said shroud including a back wall with a first section positioned centrally of and parallel to said rear wall and a separate elongated section extending laterally from each side of said first section and angled toward said rear wall, said shroud also including spaced apart top and bottom walls bridging between said rear wall and said back wall.

7. A forced air convection oven as set forth in claim 6, wherein: said fan and said air heating means are mounted between said rear and back walls in alignment with said back wall first section.

8. A forced air convection oven as set forth in claim 6, wherein: the angle between each back wall elongated section and said rear wall is substantially constant throughout the length of said elongated section so that the cross section area of each elongated section decreases at a substantially uniform rate laterally away from the junction of that elongated section with said back wall first section.

9. A forced air convection oven as set forth in claim 7, wherein: said outlet openings are elongated vertically of said rear wall.

10. A forced air convection oven as set forth in claim 7, wherein: each of said outlet openings is comprised of a plurality of small, closely spaced holes in said rear wall and the effective cross section area of each of said outlet openings is substantially the cumulative total area of the cross section areas of all the small holes comprising that opening.

* * * * *